US012644237B2

(12) United States Patent
Mcintosh

(10) Patent No.: US 12,644,237 B2
(45) Date of Patent: Jun. 2, 2026

(54) HAND TOOL

(71) Applicant: Ashurst Civils Limited, Bromsgrove (GB)

(72) Inventor: Dawn Mcintosh, Bromsgrove (GB)

(73) Assignee: Easy Slabber Holdings Limited, Birmingham (GB)

( * ) Notice: Subject to any disclaimer, the term of this patent is extended or adjusted under 35 U.S.C. 154(b) by 714 days.

(21) Appl. No.: 18/010,134

(22) PCT Filed: Jun. 15, 2021

(86) PCT No.: PCT/GB2021/051487
§ 371 (c)(1),
(2) Date: Dec. 13, 2022

(87) PCT Pub. No.: WO2021/255428
PCT Pub. Date: Dec. 23, 2021

(65) Prior Publication Data

US 2023/0128185 A1 Apr. 27, 2023

(30) Foreign Application Priority Data

Jun. 17, 2020 (GB) ..... 2009207

(51) Int. Cl.
*E01C 19/44* (2006.01)

(52) U.S. Cl.
CPC ..... *E01C 19/44* (2013.01)

(58) Field of Classification Search
CPC ..... E01C 19/44; E01C 19/484; E01C 19/40; E01C 19/15; E01C 19/402; E04F 21/241; E04G 21/10
See application file for complete search history.

(56) References Cited

U.S. PATENT DOCUMENTS 1,847,728 A * 3/1932 Schmid ..... E02F 9/26 37/906
5,671,553 A * 9/1997 Burkhart ..... E01C 19/15 37/285
6,053,659 A * 4/2000 Burton ..... E01C 19/187 404/97
6,695,531 B1 2/2004 Prescott
(Continued)

FOREIGN PATENT DOCUMENTS

CN 208650487 U 3/2019
CN 210530353 U 5/2020
(Continued)

OTHER PUBLICATIONS

Search Report for related Great Britain Patent Application No. GB2009207.8 dated Nov. 30, 2020.
(Continued)

*Primary Examiner* — Abigail A Risic
(74) *Attorney, Agent, or Firm* — Caesar Rivise, PC

(57) ABSTRACT

A hand tool for levelling screed, the hand tool comprises a main body and a screed-levelling member, the screed levelling member comprises a first portion and a second portion joined together at a vertex, the first and second portion being non-colinear or non-coplanar, wherein the first portion is secured to the main body, and the second portion is configured to level screed in use.

17 Claims, 5 Drawing Sheets

(56) References Cited

U.S. PATENT DOCUMENTS

| | | | | |
|---|---|---|---|---|
| 7,192,216 | B2 * | 3/2007 | Casale | E04F 21/04 404/101 |
| 7,470,083 | B2 * | 12/2008 | Black | E04G 21/10 404/96 |
| 7,686,538 | B2 * | 3/2010 | Lutz | E01C 19/402 404/114 |
| 10,232,403 | B1 * | 3/2019 | Daranuta | E04F 21/163 |
| 12,276,121 | B2 * | 4/2025 | Richardet | E04F 21/241 |
| 2006/0192073 | A1 * | 8/2006 | Casale | E04G 21/10 249/188 |
| 2009/0178288 | A1 * | 7/2009 | Bahler | E01C 23/07 33/518 |
| 2022/0325535 | A1 * | 10/2022 | Richardet | E04F 21/241 |

FOREIGN PATENT DOCUMENTS

| | | | | |
|---|---|---|---|---|
| GB | 2224057 | A | 4/1990 | |
| GB | 2258483 | A | 2/1993 | |
| GB | 2374103 | A | 10/2002 | |
| JP | 2017106218 | A | 6/2017 | |
| KR | 20090120152 | A | 11/2009 | |
| WO | WO-2011045569 | A2 * | 4/2011 | E04F 21/241 |

OTHER PUBLICATIONS

Examination Report for related Great Britain Patent Application No. GB2009207.8 dated Nov. 30, 2020.

* cited by examiner

HAND TOOL

CROSS-REFERENCE TO RELATED APPLICATIONS

This application is a U.S. National Phase Application of PCT/GB2021/051487, filed Jun. 15, 2021, which claims priority to GB2009207.8, filed Jun. 17, 2020, the contents of which applications are incorporated herein by reference in their entireties for all purposes.

BACKGROUND

This invention relates generally to a hand tool. More specifically, although not exclusively, this invention relates to a hand tool for use in levelling screed, for example, when laying paving or patio slabs.

Paved areas, e.g. patios, provide low maintenance and practical spaces, for example, in private gardens and public spaces such as parks and cafes. Paved areas comprise multiple slabs or blocks, laid adjacent one another, secured to the ground using screed, e.g. cement or a mortar mix. In the construction of a paved area, the worker marks out the space and determines or calculates the fall (if any), which is the slight slope or gradient across the paved area that helps surface water drain away. A paved area with a fall is still termed "level" even though it may not be perfectly horizontal. A sub-base is constructed, for example using hardcore, followed by a thin layer of sharp sand. The slabs are bedded in a screed mix, which is located on top of the sub-base. The screed is laid and levelled, and the first slab (the key slab) is laid on top of the levelled screed. Laying the first slab is crucial because it acts as a guide for the subsequently-laid slabs. The subsequent slabs are then positioned adjacent the key or first slab and bedded into the screed.

One of the biggest challenges faced by the non-professional slab layer (e.g. a casual, or do-it-yourself, slab layer, typically at home) when attempting to lay a paved area is to provide a level base of screed that is uniform and falls in the desired direction (e.g. away from a house or outbuilding). Professional installers use lengths of wood and/or trowels to level the sub-base and to level the screed ready for laying the slabs. However, this requires experience and skill to execute in an effective manner.

Moreover, paving slabs come in many shapes and sizes, with varying depths. It is also difficult for the non-professional person to determine whether the screed is being levelled to the correct depth, since adjacent slabs may have settled by the time the subsequent slab is laid.

These challenges can lead to the slabs being laid in an uneven manner, which causes issues such as trip hazards if the one slab is proud of an adjacent slab. In addition, the paved area may slope or fall in the wrong direction, or inconsistently. This can lead to water pooling in areas of the paved area, or may cause rain water to run towards buildings, which can lead to damp problems.

SUMMARY

It is therefore a first non-exclusive object of the invention to provide a hand tool that allows for screed to be levelled smoothly and accurately when laying slabs. It is a further non-exclusive object of the invention to provide a hand tool with enhanced stability to provide a uniform area of levelled screed. It is a yet further non-exclusive object of the invention to provide a hand tool with improved handleability and/or manoeuvrability, in use.

Accordingly, a first aspect of the invention provides a hand tool for levelling screed, the hand tool comprising a main body and a screed-levelling member, the screed levelling member comprising a first portion and a second portion joined together at a vertex, the first and second portion being non-colinear or non-coplanar, wherein the first portion is secured to the main body, and the second portion is configured to level screed in use.

In a more particular aspect of the invention there is provided a hand tool for levelling screed adjacent a laid slab, the hand tool comprising a main body and a screed levelling member, the screed levelling member comprising a first portion and a second portion joined together at a vertex, the first and second portion being noncolinear or non-coplanar, the first portion being secured to the main body, the second portion being configured to level screed in use, wherein the main body of the hand tool is configured to contact a laid slab such that the laid slab acts as a guide for the second portion of the screed levelling member to level the screed adjacent the laid slab.

The screed levelling member may extend below the main body

In an embodiment the screed levelling member is attached to the main body so that it extends partially along the length of the main body.

The main body may be elongate. The main body may have a first end and a second end. The screed levelling member may extend from a position between the first and second end to a position adjacent or beyond the second end of the main body. Accordingly, the main body may comprise a screed-levelling member free portion. The screed levelling member may extend from a position between the first and second ends to a second position. The second position may be adjacent the first end. The second position may be between the first and second ends. The second position may be beyond the second end.

Advantageously, the main body of the hand tool is configured to contact a laid slab such that the laid slab acts as a guide for the second portion of the screed levelling member to level the screed adjacent the laid slab. For example, in use, a first laid slab may be provided, and screed may be provided adjacent the first laid slab. The main body of the hand tool may be located on the first laid slab and the second portion may be located on a portion of the screed. The main body of the hand tool may be translated across the first laid slab to enable the second portion to level the screed. Subsequently, a second paving slab may be laid adjacent the first laid paving slab on the levelled screed. It has been surprisingly found that a hand tool comprising a screed levelling member having the configuration of the invention provides enhanced stability over hand tools of the prior art for levelling screed.

The term "vertex" is defined in a geometrical sense to mean a meeting point of two lines that form an angle. In the context of the invention, the vertex defines the meeting point of the first and second portion that form an angle. That is, the first portion and the second portion are joined at the vertex to form a vertex angle therebetween. In embodiments, the vertex angle formed between the first and second portion is greater than 0 and less than 180 degrees. In embodiments, the vertex angle formed between the first and second portion is between greater than any one of 0, 10, 20, 30, 40, 50, 60, 70, 80, 90, 100, 110, 120, 130, 140, 150, 160, 170 degrees to less than any one of 180, 170, 160, 150, 140, 130, 120, 110, 100, 90, 80, 70, 60, 50, 40, 30, 20, 10 degrees. In embodiments, the vertex angle formed between the first and second portion is greater than 0 and less than or equal to 90 degrees. In embodiments, the first and second portion are in substantially perpendicular relations, i.e. the vertex angle is substantially 90 degrees.

In embodiments, the screed levelling member may consist of the first portion and the second portion joined together at a vertex. In embodiments, the first and second portion form an L-shape. In embodiments, the screed levelling member may have a leg portion and a foot portion, the leg portion being the first portion and the foot portion being the second portion. The screed levelling member may have a leg portion and a foot portion, the leg portion being secured to the main body. In an embodiment the foot portion is axially aligned with the main body.

Advantageously, the provision of an L-shaped screed-levelling member or portion (or leg portion with non-coplanar foot portion) provides an improved guide during screed levelling.

The edge of the L-shaped portion (or leg portion with non-coplanar foot portion) engages the preceding slab in two planes, thereby making it easier for the operator to resist turning moments when drawing the tool across a slab.

The main body may have a width. The lowermost part of the L-shaped portion (or non-coplanar foot portion) may have a width. The width of the lowermost part of the L-shaped portion (or non-coplanar foot portion) may be the substantially the same as the width of the main body. In an embodiment the width of the lowermost part of the L-shaped portion (or non-coplanar foot portion) may be greater than the width of the main body.

Further the provision of an L-shaped portion (or leg portion with non-coplanar foot portion) provides a relatively broad levelling surface for engaging and levelling screed. It has been found that such a relatively broad surface provides enhanced levelling over blades or relatively thin levelling surfaces.

By providing an L-shaped portion, when not in use the screed levelling member can be brought towards the main body to provide a compact storing position. The screed levelling member may be moved away from the main body to provide a screed levelling position.

In embodiments, the second portion of the screed levelling member comprises an upper major surface and a screed-facing lower major surface. In embodiments, the screed-facing lower major surface is substantially smooth (e.g. free of indentations or projections). In alternative embodiments, the screed-facing lower major surface comprises indentations and/or projections, e.g. to provide a pattern within the levelled screed to improve adherence of the slab to the levelled screed.

In embodiments, the main body of the hand tool may comprises a leading face and a trailing face. The screed levelling member may be attached to the leading face. The main body may comprise a lower surface. In embodiments, the upper surface of the second portion of the screed levelling member is in facing relations with the lower surface of the main body of the hand tool. In embodiments, the upper surface of the second portion of the screed levelling member is substantially parallel to the lower surface of the main body.

In embodiments, the first portion of the screed levelling member comprises a first major surface and a second major surface. In embodiments, the first major surface is interior of the vertex angle and the second major surface is exterior of the vertex angle. In embodiments, the first major surface of the first portion of the screed levelling member is in facing relations with the main body of the hand tool. In embodiments, the first portion of the screed levelling member is secured to the main body by locating the first major surface of the first portion adjacent the main body of the hand tool. In alternative embodiments, the first portion of the screed levelling member is secured to the main body by locating the second major surface of the first portion in facing relations and/or adjacent the main body of the hand tool.

In embodiments, the screed levelling member comprises a first portion and a second portion in substantially perpendicular relations (e.g, wherein the vertex angle is substantially 90 degrees), wherein the first portion of the screed levelling member is secured to the main body by locating the first major surface (e.g. interior of the vertex angle) of the first portion in facing relations and/or adjacent the main body of the hand tool.

It has been surprisingly found that a hand tool having this configuration is more stable, in use, to provide improved results (e.g. more uniformly level screed) over hand tools of the prior art.

In embodiments, the first portion of the screed levelling member may be secured to the main body by a securing means or a securement. In embodiments, the securing means may comprise non-permanent or releasable securing means. In embodiments, the securing means may comprise screws, and/or nuts and bolts. In embodiments, the securing means may comprise one or more bolts and/or one or more nuts for pairing with the bolts to secure the first portion of the screed levelling member to the main body of the hand tool. In embodiments, the one or more bolts may be secured (e.g. permanently secured) to the main body of the hand tool. In alternative embodiments, the bolts may be provided separately to be main body. In embodiments, the bolts may be releasably secured to the main body, in use. In embodiments, the first portion of the screed levelling member May comprise one or more apertures or slots for locating one or more bolts therethrough.

In embodiments, the securing means may comprise permanent or non-releasable securing means, for example, adhesive.

In embodiments, the hand tool may comprise a depth adjustment means (or a depth adjuster) usable to adjust the depth of the second portion of the screed levelling member relative to the main body. In embodiments, the depth adjustment means may comprise the securing means. In embodiments, the depth adjustment means may be configured to allow translational movement of the screed levelling member relative to the main body to vary the distance between the second portion of the screed levelling member and the main body, in use. In embodiments, the depth adjustment means may be configured to secure the screed levelling member at one or more depths, e.g. one or more depths along a continuous scale, or one or more depths along a discrete scale, for example, one or more defined or fixed depths, for example, two, three, four, or more defined or fixed depths.

In embodiments, the depth adjustment means may have a range of between 40-160 mm in length, e.g. between 50-140 mm, or between 60-120 mm, or between 70-100 mm, or between 80-90 mm in length, e.g. 80 mm.

In embodiments, the depth adjustment means may comprise one or more (e.g. elongated) slots located in the first portion of the screed levelling member for the location of one or more bolts therethrough. In embodiments, the depth adjustment means may comprise one or more bolts, and/or one or more nuts and bolts, for securing the first portion to the main body of the hand tool. In embodiments, the depth adjustment means may comprise a first slot and a second slot (e.g. a pair of slots) located in the first portion of the screed levelling member for the location of bolts therethrough. In embodiments, the depth adjustment means comprises, three, four, or more slots located in the first portion of the screed levelling member for the location of bolts therethrough. In embodiments, the one or more bolts and/or nuts may be loosened or tightened to adjust the depth of the second portion of the screed levelling member relative to the main body.

In embodiments, the slots are between 40-160 mm in length, e.g. between 50-140 mm, or between 60-120 mm, or between 70-100 mm, or between 80-90 mm in length, e.g. 80 mm.

In embodiments, the one or more slots may comprise a depth gauge to measure the required depth of the second portion of the screed levelling member. In embodiments, the one or more slots may comprise one or more markers to indicate one or more defined depths of the second portion relative to the main body. In embodiments, the one or more slots may comprise one or more abutments or teeth at different depths on or along each slot, which are configured to support and/or engage with the bolts to secure the first portion of the screed levelling member to the main body at one or more fixed or defined depths.

In alternative embodiments, the depth adjustment means may comprise a ratchet comprising a gear and pawl mechanism.

Advantageously, the depth adjustment means is usable to adjust the depth of the second portion of the screed levelling member relative to the main body to accommodate paving slabs of different depths. In this way, the hand tool is usable to level screed adjacent a laid paving slab having any depth within the range of the depth adjusting means of the hand tool.

In embodiments, the hand tool comprises at least one handle, e.g. two handles, three handles, or more than three handles. In embodiments, the handles are located on the main body. Advantageously, the handles enable improved usability such as better maneuverability of the hand tool, in use.

In embodiments, the main body comprises a first handle and a second handle. In embodiments, first and second handle may be located on the hand tool such that the weight of the hand tool is evenly distributed about the centre of mass of the hand tool when it is held with both hands by the user. For example a first handle may be provided at or towards the or a first end of the main body and a second handle may be provided at or towards the or a second end of the main body. Advantageously, this improves the grip and comfort for the user when holding the hand tool.

In embodiments, the hand tool comprises an elongate handle. The elongate handle may comprise a shaft connected to the main body of the hand tool.

The elongate handle may comprise a connecting means to connect the elongate handle to the main body of the hand tool. In embodiments, the elongate handle is removable from the main body. In embodiments, the connecting means is releasable to release the shaft of the elongate handle from the main body. In embodiments, the main body of the hand tool may comprise one or more fixing locations (e.g. two, three, four, or more fixing locations) to connect the connecting means of the elongate handle to the main body of the hand tool.

In embodiments, the connecting means comprises a male screw fixing on the elongate handle, which couples to a female fixing location on the main body of the hand tool. In alternative embodiments, the connecting means comprises a female screw fixing on the elongate handle, which couples to a male fixing location on the main body of the hand tool. In embodiments, the main body may comprise one or more (e.g. female or male) fixing locations (e.g. two, three, four, or more fixing locations). Advantageously, the provision of multiple fixing locations enables the user to move the elongate handle to different locations on the main body such that the hand tool is adapted to best suit the user.

In embodiments, the central axis of the elongate handle may be angled with respect to the central axis of the main body of the hand tool.

In embodiments, the elongate handle is between 500 mm-2000 mm in length, for example, between 600-1900 mm in length, or between 700-1800 mm in length, or between 800-1700 mm, or between 900-1600 mm, or between 1000-1500 mm, or between 1100-1400 mm, or between 1200-1300 mm.

Advantageously, the elongate handle enables use of the hand tool whilst the user is standing. This aids usability by improving maneuverability of the hand tool in use.

In embodiments, the hand tool may comprise a spirit level. In embodiments, the spirit level may be usable to determine the angle of the main body and/or the second portion of the screed levelling member relative to earth, in use. In embodiments, the spirit level may be usable to determine the true horizontal relative to earth, that is, the spirit level may be used to determine whether the main body and/or the second portion is level relative to earth, in use.

In embodiments, the spirit level may be usable to determine whether the main body and/or the second portion of the screed levelling member is level with respect to a specified slope or fall relative to earth.

In embodiments, the spirit level comprises one or more lines or markers configured to determine a non-level, i.e. a non-true horizontal, angle of the main body and/or the second portion in use. The one or more markers may be usable to determine one or more values of a desired or required slope or fall or gradient of the main body and/or the second portion, in use. In embodiments, the one or more markers may be usable to determine a slope or fall or gradient of 5 mm drop per 1.5 metres length (fall of 1:300), or 10 mm drop per 1.5 metres length (fall of 1:150), 15 mm per 1.5 meters (fall of 1:100) or 12.5 mm drop per meter length (fall of 1:80). Larger or smaller falls can be used . . . . In an embodiment the one or markers may comprises a first set of markers, a second set of markers and an optional third set of markers (and optional nth set of markers). The first set of markers may comprise one or more markers arranged to indicate when the tool is horizontal. The second set of markers may comprise one or more markers arranged to indicate when the tool is oriented at a first desired incline (e.g 10 mm per 1.5 m). The optional third (or nth) set of markers may comprise one or more markers arranged to indicate when the tool is oriented at a second desired incline (e.g 0.5 mm or 1.5 mm drop per 1.5 m). The markers, e.g. the first and second set of markers may be presented differently from one another (e.g. colour coded) for easy visual identification.

Advantageously, the ability to easily determine the slope or fall of the second portion enables the screed to be levelled at an angle relative to earth. For example, when laying slabs, e.g. for a paved area, it is advantageous for area of laid slabs to slope away from nearby buildings for drainage of rain water.

In embodiments, the main body has a height of between 20-60 mm, e.g. between any one of 20, 25, 30, 35, 40, 45, 50, 55 mm to any one of 60, 55, 50, 45, 40, 35, 30, 25 mm. In embodiments, the main body has a height of between 30-50 mm, for example between 35-45 mm, e.g. 40 mm.

In embodiments, the main body has a length of between 50-2000 mm, e.g. between any one of 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, or 1950 mm, to any one of 2000, 1950, 1900, 1850, 1800, 1750, 1700, 1650, 1600, 1550, 1500, 1450, 1400, 1350, 1300, 1250, 1200, 1150, 1100, 1050, 1000, 950, 900, 850, 800, 750, 700, 650, 600, 550, 500, 450, 400, 350, 300, 250, 200, 150, or 100 mm. In embodiments, the main body has a length of between 1000-1400 mm, for example between 1100-1300 mm, e.g. 1200 mm.

In embodiments, the main body has a width of between 20-60 mm, e.g. between any one of 20, 25, 30, 35, 40, 45, 50, 55 mm to any one of 60, 55, 50, 45, 40, 35, 30, 25 mm. In embodiments, the main body has a width of between 30-50 mm, for example between 35-45 mm, e.g. 40 mm.

In embodiments, the main body comprises a flat surface for contacting first paving slab. In embodiments, the flat surface of the main body has a width of between 20-60 mm, e.g. between any one of 20, 25, 30, 35, 40, 45, 50, 55 mm to any one of 60, 55, 50, 45, 40, 35, 30, 25 mm. In embodiments, the length of the flat body of the main body is approximately half the length of the main body. In embodiments, the flat surface has a length of between 25-1000 mm, e.g. between any one of 25, 50, 75, 100, 150, 200, 250, 300, 350, 400, 450, 500, 550, 600, 650, 700, 750, 800, 850, 900, 950 mm to any one of 1000, 950, 900, 850, 800, 750, 700, 650, 600, 550, 500, 450, 400, 350, 300, 250, 200, 150, 100, or 50 mm. Advantageously, the flat surface provides stability when the main body is translated across the first paving slab.

In embodiments, the main body may be cuboid or square tubular in shape.

In embodiments, the main body comprises or is fabricated from metal (e.g. aluminium and/or steel), wood, and/or a polymeric material such as a plastic. Advantageously, the main body may be fabricated to be lightweight, which improves the usability by making the hand tool easier to hold and preventing a worker from tiring.

In embodiments, the first portion of the screed levelling member has a height, a length, and a thickness.

In embodiments, the length of the first portion is between 400-800 mm, for example, between 450-750 mm, or between 500-700 mm, or between 550-650 mm, or between 570-630 mm. In embodiments, the length of the first portion is 620 mm.

In embodiments, the height of the first portion is between 60-180 mm, for example, between 70-170 mm, or between 80-160 mm, or between 90-150 mm, or between 100-140 mm, or between 110-130 mm. In embodiments, the width of the first portion is 120 mm.

In embodiments, the thickness of the first portion is between 5 to 30 mm, e.g. between 6-25 mm, or between 7-20 mm, or between 8-15 mm, or between 9-10 mm. In embodiments, the thickness of the first portion is 10 mm.

In embodiments, the second portion of the screed levelling member has a width, a length, and a thickness. In embodiments, the length of the first portion and/or second portion may be approximately half the length of the main body. In embodiments, the length of the second portion may be the same dimension as the length of the first portion of the screed levelling member. In embodiments, the thickness of the second portion may be the same dimension as the thickness of the first portion of the screed levelling member.

In embodiments, the length of the second portion is between 400-800 mm, for example, between 450-750 mm, or between 500-700 mm, or between 550-650 mm, or between 570-630 mm. In embodiments, the length of the second portion is 620 mm.

In embodiments, the width of the second portion is between 5-150 mm, or between 10-130 mm, or between 15-110 mm, or between 20-90 mm, or between 25-70 mm, or between 30-50 mm, or between 35-45 mm. In embodiments, the width of the second portion is greater than or equal to 10 mm, or 20 mm, or 30 mm, or 40 mm.

In embodiments, the thickness of the second portion is between 5 to 30 mm, e.g. between 6-25 mm, or between 7-20 mm, or between 8-15 mm, or between 9-10 mm. In embodiments, the thickness of the second portion is 10 mm.

Advantageously, the second portion is dimensioned to provide a large surface area for contacting the screed, which is more effective at levelling the screed in comparison to hand tools of the prior art.

A further aspect of the invention provides a method for levelling screed, the method comprising:

i. providing a hand tool, the hand tool comprising a main body and a screed-levelling member, the screed levelling member comprising a first portion and a second portion joined together at a vertex, the first and second portion being non-colinear or non-coplanar, wherein the first portion is secured to the main body;
ii. providing a guide object (e.g. a first laid slab);
iii. providing screed adjacent the guide object (e.g. the first laid slab);
iv. locating the main body of the hand tool on the guide object (e.g. the first laid slab) and the second portion on a portion of the screed;
v. translating the main body of the hand tool across the guide object (e.g. first laid slab) to enable the second portion to level the screed.

The method may further comprise step vi. laying a slab (e.g. a second slab) on the levelled screed.

Advantageously, the method of the invention enables the guide object (e.g. the first laid slab) to be used as a guide such that the second portion of the screed levelling member can level the screed adjacent the guide object (e.g. the first laid slab).

The hand tool for use in the method of the invention may comprise any feature or combination of features previously described.

In embodiments, step ii. providing a guide object (e.g. a first slab) may comprise laying a guide object (e.g. a first slab) onto a portion of screed at a desired angle, for example, using a hand tool comprising a spirit level. The desired angle may be level relative to earth, or at a specified or defined slope or fall.

In embodiments, the method may comprise step vi. to be performed before step iv, wherein step vi. comprises adjusting the depth of the second portion relative to the main body of the hand tool to a predetermined or desired depth. Step vi. may comprise adjusting the depth of the second portion relative to the main body of the hand tool to the depth of the guide object (e.g. a first slab) or the depth of a slab (e.g. a second slab).

Advantageously, the method of the invention enables the user to level screed in a simple, quick, and effective manner. The configuration of the screed levelling member provides improved stability over hand tools of the prior art, such that the main body may be translated over a guide object to level screed adjacent the guide object at a desired level or fall relative to earth. This enables the user to rapidly lay, for example, paving slabs to create a paved area that is level, or has a desired slope or fall. More advantageously, the depth of the second portion relative to the main body of the hand tool may be adjusted such that the hand tool may be used to lay slabs having different depths. The invention is especially advantageous for a beginner or a non-professional for use in "DIY". The non-professional user may not have experience of laying a paved area prior to using the hand tool of the invention.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only with reference to the accompanying drawings in which.

DETAILED DESCRIPTION

Figure 1:
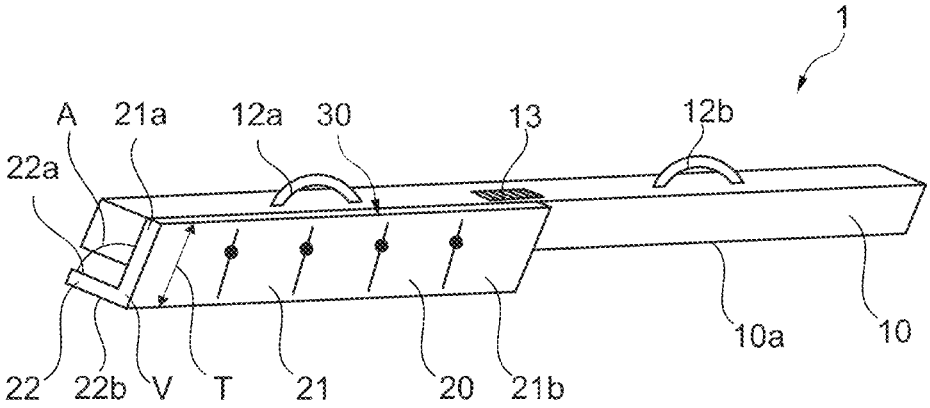
FIG. 1 is a hand tool according to an embodiment of the invention.
Figure 2:
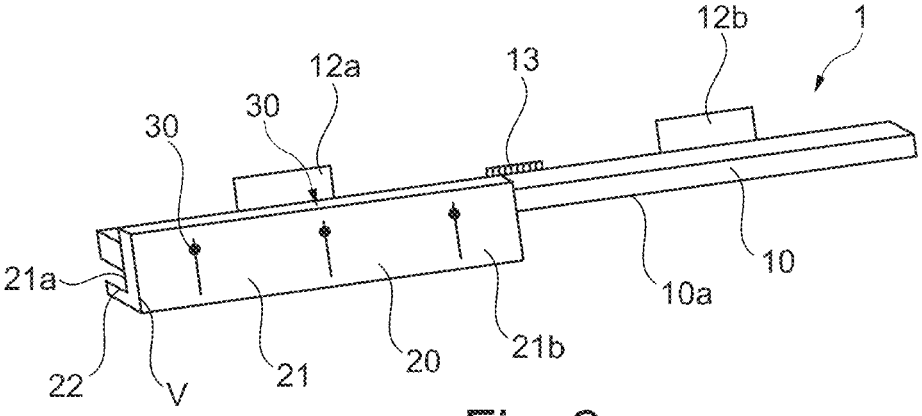
FIG. 2 is the hand tool of FIG. 1.

Referring now to FIG. 1, there is shown a hand tool 1 according to an embodiment of the invention. The hand tool 1 is suitable for use in levelling screed, for example, when laying paving slabs, e.g. for a patio.

The hand tool 1 comprises a main body 10 and a screed-levelling member 20.

The main body 10 has an intended leading face and an intended trailing face. The screed levelling member 20 is secured to the leading face of the main body 10.

The screed levelling member 20 comprises a first portion 21 (e.g. a leg portion) and a second portion 22 (e.g. a foot portion). The first portion 21 and the second portion 22 are non-coplanar and are joined together at a vertex V.

The vertex V defines the meeting point of the first portion 21 and the second portion 22 to form a vertex angle A therebetween. In this embodiment, the first portion 21 and the second portion 22 are in substantially perpendicular relations to form an L-shape, i.e. the vertex angle A is approximately 90 degrees.

The first portion 21 of the screed levelling member 20 is secured to the main body 10 using securing means 30. In this embodiment, the securing means 30 are non-permanent and releasable. The first portion 21 of the screed levelling member 20 comprises a first major surface 21*a* and a second major surface 21*b*. The first major surface 21*a* is interior of the vertex angle A and the second major surface 21*b* is exterior of the vertex angle A. The first portion 21 of the screed levelling member 20 is secured to the main body 10 by locating the first major surface 21*a* of the first portion 21 adjacent the main body 20 of the hand tool 10.

The main body 10 is elongate. In this embodiment, the screed levelling member 20 is attached to the main body 10 so that it extends partially along the length D3 of the main body 10 such that the main body 10 comprises a screed-levelling member free portion.

The second portion 22 of the screed levelling member 20 is configured to level screed, in use. The second portion 22 of the screed levelling member 20 comprises an upper surface 22*a* and a screed-facing lower major surface 22*b*.

The main body 10 comprises a lower surface 10*a*.

In this embodiment, the upper surface 22*a* of the second portion 22 of the screed levelling member 20 is in facing relations with, and is substantially parallel to, the lower surface 10*a* of the main body 10 of the hand tool 1. In other words, the second portion 22 (e.g. the foot portion) is axially aligned with the main body 10.

The hand tool 1 also comprises a first and second handle 12*a*, 12*b* located on the main body 10. The first and second handle 12*a*, 12*b* are located on the main body 10 of the hand tool 1 such that the weight of the hand tool 1 is evenly distributed about its centre of mass when the hand tool 1 is held with both hands by the user.

Advantageously, the handles 12*a*, 12*b* enable improved usability such as better maneuverability of the hand tool. The distribution of weight improves the grip and comfort for the user when holding the hand tool.

Figure 3:
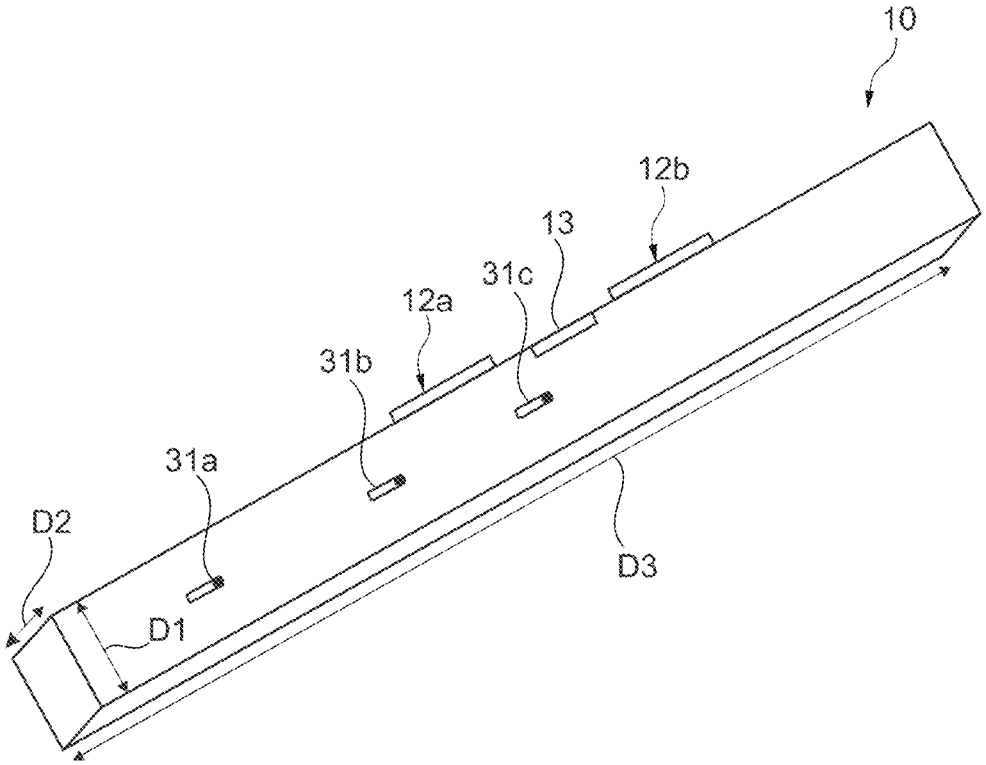
FIG. 3 is the main body of the hand tool of FIGS. 1 and 2.

Referring also to FIG. 3, there is shown the main body 10 of the hand tool 1. In this embodiment, the main body 10 comprises three bolts 31*a*, 31*b*, 31*c*, which are permanently secured to the main body 10 of the hand tool 1.

Figure 4:
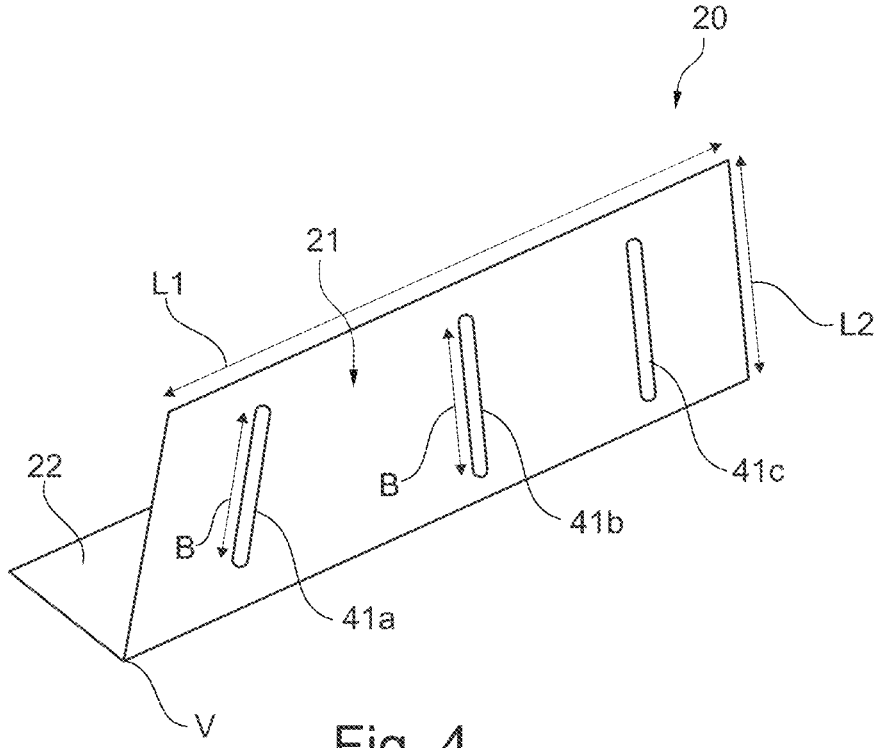
FIG. 4 is the screed levelling member of the hand tool of FIGS. 1 and 2.
Figure 5:
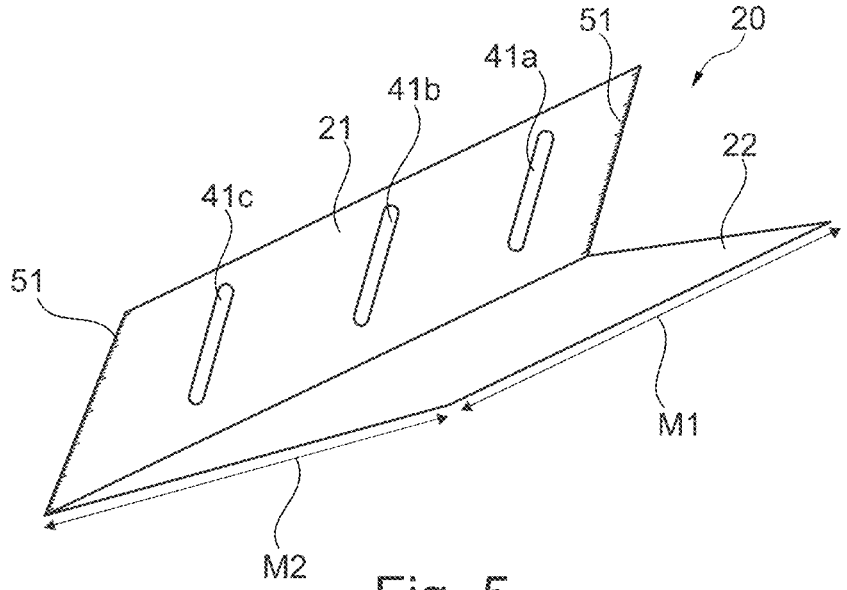
FIG. 5 is the screed levelling member of the hand tool of FIGS. 1 and 2.

Referring also to FIGS. 4 and 5, there is shown the screed levelling member 20 of the hand tool 1. The first portion 21 of the screed levelling member 20 comprises three apertures or slots 41*a*, 42*a*, 43*a* for locating the three bolts 31*a*, 31*b*, 31*c* of the main body 10 therethrough.

In this embodiment, the securing means 30 comprises the three bolts 31*a*, 31*b*, 31*c* and the three nuts (not shown) for pairing with the three bolts 31*a*, 31*b*, 31*c* to secure the first portion 21 of the screed levelling member 20 to the main body 10 of the hand tool 1.

The hand tool 1 further comprises a depth adjustment means usable to adjust the depth of the second portion 22 of the screed levelling member 20 relative to the main body 10. In this embodiment, the securing means 30 is part of the depth adjustment means. The depth adjustment means comprises the three bolts 31*a*, 31*b*, 31*c*, the three nuts 32*a*, 32*b*, 32*c*, and the slots 41*a*, 42*a*, 43*a*.

The depth adjustment means is configured to allow translational movement (illustrated with arrow T in FIG. 1) of the screed levelling member 20 relative to the main body 10 to vary the distance between the second portion 22 of the screed levelling member 20 and the main body 10.

The depth adjustment means is configured to secure the screed levelling member at one or more depths along a continuous scale. Each slot 41*a*, 42*a*, 43*a* on the first portion 21 of the screed levelling member 20 has a length B of 80 mm, such that the depth adjustment means has a range of, say, 20-80 mm.

The first portion 21 further comprises a depth gauge 51 to measure the depth of the second portion 22 of the screed levelling member 20 relative to the main body 10 (as shown in FIG. 5). Advantageously, the depth gauge 51 may be used to adjust the depth of the screed levelling member 20 to the required depth for a specific paving slab.

In other embodiments, the three slots 41*a*, 42*a*, 43*a* may comprise one or more abutments or teeth to indicate one or more defined depths of the second portion 22 relative to the main body 10, which are configured to support and/or engage with the three bolts 31*a*, 31*b*, 31*c* to secure the first portion 21 of the screed levelling member 20 to the main body 10 at one or more fixed or defined depths.

In use, the first portion 21 of the screed levelling member 20 is secured to the main body 10 by locating each bolt 31*a*, 31*b*, 31*c* through each slot 41*a*, 42*a*, 43*a*. The user is able to select the desired depth of the second portion 22 of the screed levelling member 20 by moving or sliding the first portion 21 in the direction indicated by the arrow T in FIG. 1. Once the first portion 21 is in the correct position, the nuts 32*a*, 32*b*, 32*c* are paired with the bolts 31*a*, 31*b*, 31*c* and are tightened such that the first portion 21 is rigidly secured to the main body 10.

The hand tool 1 further comprises a spirit level 13 located on the main body 10. The spirit level 10 is usable to determine the angle of the main body 10 and/or the second portion 22 of the screed levelling member 20 relative to earth, in use. For example, the spirit level 13 is usable to determine whether the main body 10 and/or the second portion 22 is level relative to earth. The spirit level 13 is also usable to determine whether the main body 10 and/or the second portion 22 of the screed levelling member 20 is at a specified slope or fall relative to earth. Although not shown, the spirit level 13 comprises one or more markers configured to determine one or more values of a slope or fall or gradient of the main body 10 and/or the second portion 22.

Advantageously, the spirit level 13 may be used to lay an area of paving slabs with a fall or slope, relative to horizontal. This allows for the drainage of rain water away from nearby buildings.

Although it is not shown in the Figures, the spirit level 13 is usable to indicate the fall of the screed when using the hand tool 1. For example, if the bubble (not shown) of the spirit level 13 sits within a set of red lines (not shown), then this will indicate the laid slab will be level. In addition, if the edge of the bubble touches an orange line (not shown), then this will indicate a slight fall on the laid slab which will cause the water to run off them slowly. If the edge of the bubble touches a green line (not shown), then this will indicate a large fall, meaning the water will easily run off the laid slab. Advantageously, the spirit level according to this design aids those users who are less experienced in slab laying, in terms of allowing the user to find the right fall for the slabs being laid. For example, the markers may be set to a specific fall. For example the markers may comprise a first pair of markers to indicate that the main body is horizontal (e.g. a pair or markers which, if the bubble of the spirit level lies therebetween indicates that the main body is level) and a second pair of markers to indicate a fall of 1:100 and a third pair of markers to indicate a fall of 1:80. Further or different pairs of markers may be provided.

The main body 10 has a height D1 of 40 mm, a width D2 of 40 mm, length D3 of 1200 mm. The main body 10 is cuboid in shape.

The main body 10 is fabricated from one of, or a combination of, metal (e.g. aluminium and/or steel), wood, and/or a polymeric material such as a plastic. Advantageously, the use of lightweight material improves the usability by making the hand tool easier to hold and preventing a worker from tiring.

The first portion 21 of the screed levelling member 20 has a length L1 of 620 mm, a width L2 of 120 mm, and a thickness (not shown) of 10 mm.

The second portion 22 of the screed levelling member 20 has a length M1 of 620 mm, a width M2 of 40 mm, and a thickness (not shown) of 10 mm. Advantageously, the second portion 22 is dimensioned to provide a large surface area for contacting the screed, in use, which is more effective at levelling the screed in comparison to hand tools of the prior art.

Advantageously, the configuration of the L-shaped first and second portions 21, 22 of the screed levelling member 20 and the main body 10 provides a stable and lightweight hand tool to level screed, e.g. for use in laying paving slabs. The large surface area of the second portion 22 provides enhanced levelling properties in comparison to hand tools of the prior art.

The provision of an L-shaped screed-levelling member 20 provides an improved guide during screed levelling. The edge of the L-shaped screed-levelling member 20 engages the preceding or guide slab in two planes, thereby making it easier for the operator to resist turning moments when drawing the tool across a slab and levelling screed.

Furthermore, the provision of an L-shaped screed-levelling member 20 provides a relatively broad levelling surface for engaging and levelling screed. It has been found that such a relatively broad surface provides enhanced levelling over blades or relatively thin levelling surfaces.

Also, the L-shaped member 20 can be brought into close proximity with the main body 10 thereby providing a relatively small footprint during storage.

Figure 6:
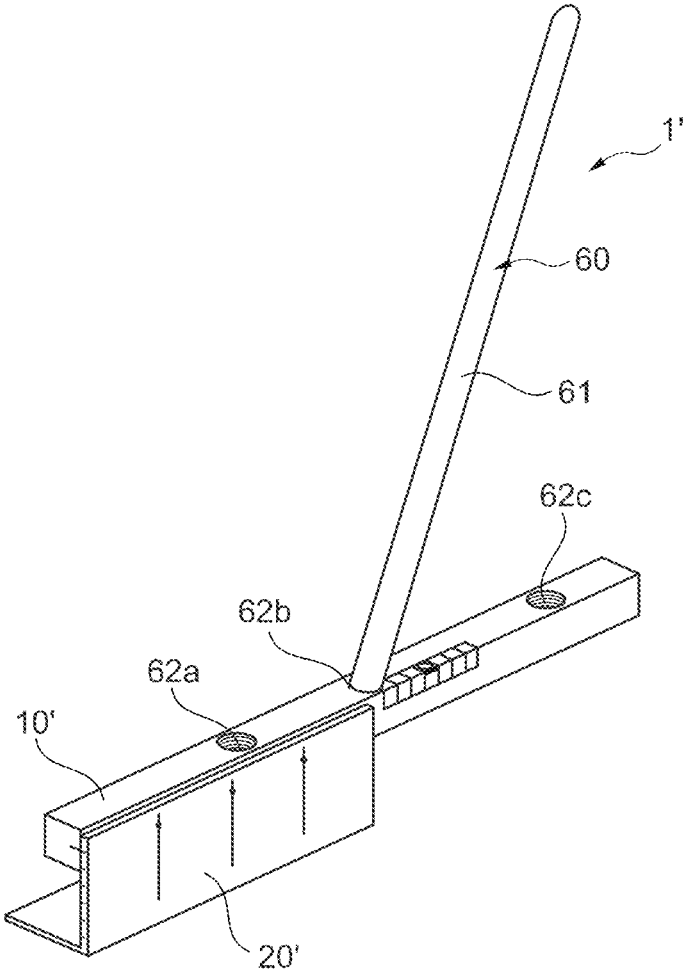
FIG. 6 is a hand tool according to a further embodiment of the invention.

Referring now to FIG. 6, there is shown a hand tool 1' according to a further embodiment of the invention. The hand tool 1' comprises similar features to those described in respect of the hand tool 1 in FIG. 1. Those features are represented with a prime (′). The hand tool 1' comprises an elongate handle 60. The elongate handle 60 comprises a shaft 61 connected to the main body 10' of the hand tool 1'. The elongate handle 60 comprises a connecting means (not shown) to connect the shaft 61 to the main body 10'.

The elongate handle 60 is removable from the main body. The main body 10' comprises comprise three female fixing locations 62*a*, 62*b*, 62*c* to connect the connecting means (not shown) of the shaft 61 of the elongate handle 60 to the main body 10' of the hand tool 1.

In this embodiment, the connecting means comprises a male screw fixing on the shaft 61 of the elongate handle 60, which couples to the three female fixing locations 62*a*, 62*b*, 62*c* on the main body 10 of the hand tool 1. Advantageously, the provision of multiple fixing locations 62*a*, 62*b*, 62*c* enables the user to move the elongate handle to different locations on the main body such that the hand tool is adapted to best suit the user.

In this embodiment, the elongate handle is between 1400-1600 mm in length.

Advantageously, the elongate handle enables use of the hand tool whilst the user is standing. This aids usability by improving maneuverability of the hand tool in use.

Figure 7A:
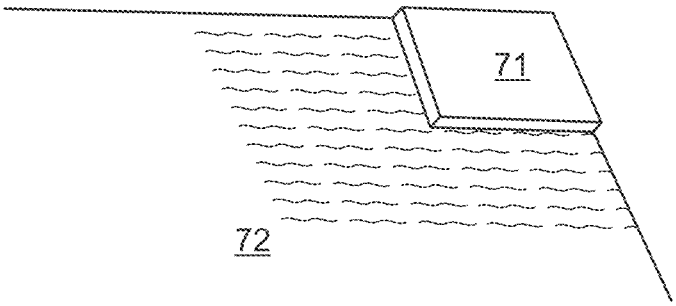
FIGS. 7A and 7B are illustrations of a method of using the hand tool of FIG. 1 or 2.
Figure 7B:
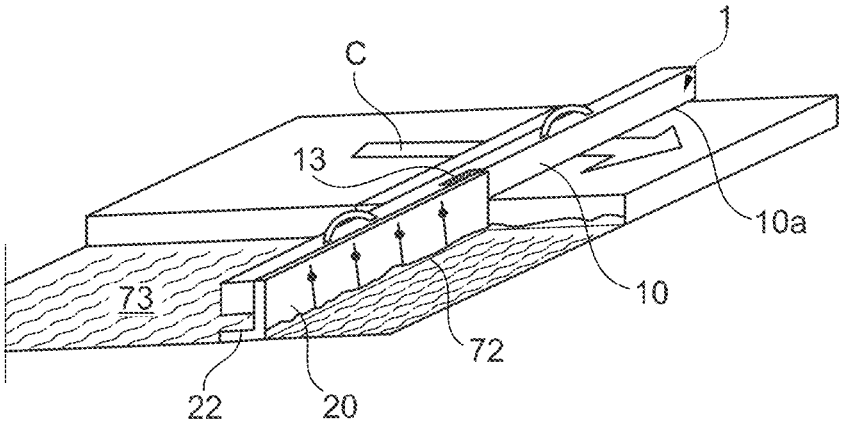

Referring now to FIGS. 7A and 7B, there is shown an illustration of the method of using the hand tool 1 of the invention to level screed. Referring first to FIG. 7A, there is shown a laid slab 71 and screed 72 adjacent the laid slab 71. The laid slab 70 acts as a guide object for the hand tool 1 in the method of levelling screed according to the invention.

A hand tool 1 according to FIG. 1 is provided. The hand tool 1' of FIG. 6 may also be used.

Referring now to FIG. 7B, in use, the lower surface 10*a* of the main body 10 of the hand tool 1 is located on the laid slab 71. The second portion 22 of the screed levelling member 20 is located on the screed 72 adjacent the laid slab 71.

The spirit level 13 may be used to determine whether the main body 10 and/or the second portion 22 is level relative to earth, or alternatively, whether the main body 10 and/or second portion 22 is at the desired angle or slope or fall. This enables the screed to be levelled at a desired angle or slope or fall to aid rain water runoff.

The depth adjustment means may be used to adjust the depth of the second portion 22 of the screed levelling member 20 relative to the main body 10 by using the laid slab 71 as a guide depth.

In use, the main body 10 of the hand tool 1 is translated across the laid slab 71 in the direction shown by the arrow C. This enables the second portion 22 of the screed levelling member 20 to contact the screed 72 to provide an area of levelled screed 73. A second slab (not shown) may then be laid on the levelled screed 73.

The method of the invention enables the laid slab 71 to be used as a guide such that the second portion 22 of the screed levelling member 20 can level the screed 72 adjacent the laid slab to provide levelled screed 73.

Advantageously, the method of the invention enables the user to level screed in a simple, quick, and effective manner. The configuration of the screed levelling member provides improved stability over hand tools of the prior art, such that the main body may be translated over a guide object to level screed adjacent the guide object at a desired level or fall relative to earth. This enables the user to rapidly lay, for example, paving slabs to create a paved area that is level, or has a desired slope or fall. More advantageously, the depth of the second portion relative to the main body of the hand tool may be adjusted such that the hand tool may be used to lay slabs having different depths. The invention is especially advantageous for a beginner or a non-professional for use in "DIY". The non-professional user may not have experience of laying a paved area prior to using the hand tool of the invention.

More advantageously, use of the hand tool 1' in the method of the invention, comprising an elongate handle 60 which is angled away from the screed levelling member 22', allows for use of the hand tool 1' whilst the user is standing, and makes the product easier to drag and manoeuvre.

It will be appreciated by those skilled in the art that several variations to the aforementioned embodiments are envisaged without departing from the scope of the invention. It will also be appreciated by those skilled in the art that any number of combinations of the aforementioned features and/or those shown in the appended drawings provide clear advantages over the prior art and are therefore within the scope of the invention described herein.

The invention claimed is:

1. A hand tool for levelling screed, the hand tool comprising a main body and a screed-levelling member, the screed levelling member comprising a first portion and a second portion joined together at a vertex, the first and second portion being non-colinear or non-coplanar, wherein the first portion is secured to the main body, and the second portion is configured to level screed in use, and wherein the screed levelling member is attached to the main body such that it extends partially along the length of the main body, and wherein the main body is elongate and comprises a width dimension and a length dimension that is greater than the width dimension, and the second portion comprises a width dimension that is parallel to the width dimension of the main body and is the same as or greater than the width dimension of the main body.

2. A hand tool according to claim 1, wherein the main body comprises a first end, a second end and a lowermost surface extending from the first end to the second end and the screed levelling member is attached to the main body so that it extends partially along the length of the main body.

3. A hand tool according to claim 1, wherein the first portion and the second portion are joined at the vertex to form a vertex angle therebetween, the vertex angle being greater than 0 and less than 180 degrees.

4. A hand tool according to claim 1, wherein the first and second portion form an L-shape wherein the first portion is a leg portion, and the second portion is a non-coplanar foot portion.

5. A hand tool according to claim 4, wherein the leg portion is secured to the main body and/or the foot portion is axially aligned with the main body.

6. A hand tool according to claim 1, comprising a depth adjuster usable to adjust the position of the second portion of the screed levelling member relative to the main body and wherein the depth adjuster has a range of between 40-160 mm in length.

7. A hand tool according to claim 6, wherein the depth adjuster is configured to secure the screed levelling member at one or more depths, selected from one or more depths along a continuous scale or one or more depths along a discrete scale.

8. A hand tool according to claim 6, wherein the depth adjuster comprises one or more slots located in the first portion of the screed levelling member or in the main body.

9. A hand tool according to claim 8, comprising one or more members arranged to engage with the slots and wherein said one or more members are selectively securable relative to the slots to alter the depth of the screed levelling member relative to the main body.

10. A hand tool according to any claim 1, further comprising a depth gauge to measure the required depth of the second portion of the screed levelling member.

11. A hand tool according to claim 1, comprising at least one handle located on the main body.

12. A hand tool according to claim 11, comprising a first and second handle located on the hand tool, the first handle being located at or towards a first end of the main body and the second handle being located at or towards a second end of the main body.

13. A hand tool according to claim 11, comprising an elongate handle comprising a shaft connected to the main body of the hand tool by a connecting means.

14. A hand tool according to claim 13, wherein the main body of the hand tool comprises one or more fixing locations (e.g. two, three, four, or more fixing locations) to connect the connecting means of the elongate handle to the main body of the hand tool.

15. A hand tool according to claim 1, further comprising a spirit level usable to determine the angle of the main body and/or the second portion of the screed levelling member relative to earth, in use.

16. A hand tool according to claim 15, wherein the spirit level comprises one or more lines or markers configured to determine a non-level, i.e. a non-true horizontal, angle of the main body and/or the second portion in use.

17. A method for levelling screed, the method comprising:

i. providing a hand tool according to claim 1;

ii. providing a guide object;

iii. providing screed adjacent the guide object;

iv. locating the main body of the hand tool on the guide object and the second portion on a portion of the screed;

v. translating the main body of the hand tool across the guide object to enable the second portion to level the screed.

* * * * *